US010345028B2

(12) United States Patent
Takami et al.

(10) Patent No.: US 10,345,028 B2
(45) Date of Patent: Jul. 9, 2019

(54) EVAPORATORS, METHODS FOR DEFROSTING AN EVAPORATOR, AND COOLING APPARATUSES USING THE EVAPORATOR

(71) Applicant: Panasonic Intellectual Property Management Co., Ltd., Osaka (JP)

(72) Inventors: Fuminori Takami, Osaka (JP); Terutsugu Segawa, Osaka (JP); Katsunori Horii, Shiga (JP); Hisakazu Sakai, Shiga (JP); Yoshimasa Horio, Shiga (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 108 days.

(21) Appl. No.: 15/603,990

(22) Filed: May 24, 2017

(65) Prior Publication Data

US 2017/0363342 A1 Dec. 21, 2017

(30) Foreign Application Priority Data

Jun. 17, 2016 (JP) ..... 2016-120320
Mar. 13, 2017 (JP) ..... 2017-046864

(51) Int. Cl.
*F25D 21/08* (2006.01)
*F25B 41/04* (2006.01)
*F25B 49/02* (2006.01)

(52) U.S. Cl.
CPC ..... *F25D 21/08* (2013.01); *F25B 41/04* (2013.01); *F25B 49/02* (2013.01); *F25B 2400/0409* (2013.01); *F25B 2400/19* (2013.01); *F25B 2600/0251* (2013.01); *F25B 2600/2501* (2013.01)

(58) Field of Classification Search
USPC ..... 62/81
See application file for complete search history.

(56) References Cited

U.S. PATENT DOCUMENTS 2,440,146 A * 4/1948 Kramer ..... F25B 31/004 62/155
3,592,170 A * 7/1971 Burkle ..... F22B 29/12 122/406.4

(Continued)

FOREIGN PATENT DOCUMENTS

JP 10-038453 2/1998

*Primary Examiner* — Henry T Crenshaw
(74) *Attorney, Agent, or Firm* — Panasonic IP Management; Kerry S. Culpepper

(57) ABSTRACT

A method for defrosting an evaporator, includes: (i) closing an outlet part that serves as a refrigerant outlet of the evaporator; (ii) closing an inlet part that serves as a refrigerant inlet of the evaporator; (iii) connecting the outlet part and the inlet part to one another; (iv) heating the evaporator. An evaporator, includes: an inlet part that serves as a refrigerant inlet; a first switching valve that is placed in the inlet part; an outlet part that serves as a refrigerant outlet; a second switching valve that is placed in the outlet part; a bypass pathway that connected the inlet part and the outlet part to one another; a horizontal pipe that is communicated with the inlet part; and a vertical pipe that connects the horizontal pipe and the outlet part to one another. A cooling apparatus can include the evaporator.

12 Claims, 4 Drawing Sheets

(56) References Cited

U.S. PATENT DOCUMENTS

| | | | | | |
|---|---|---|---|---|---|
| 4,023,377 | A * | 5/1977 | Tomita | F25B 47/022 | 62/196.4 |
| 5,983,639 | A * | 11/1999 | Kral | F22B 35/14 | 110/101 C |
| 2018/0093549 | A1 * | 4/2018 | Resutek | B60H 1/00485 | |

* cited by examiner

EVAPORATORS, METHODS FOR DEFROSTING AN EVAPORATOR, AND COOLING APPARATUSES USING THE EVAPORATOR

TECHNICAL FIELD

The technical field relates to evaporators, methods for defrosting an evaporator, and cooling apparatuses using the evaporator. In particular, the technical field relates to refrigerators, evaporators used for a refrigerator, and methods for defrosting an evaporator.

BACKGROUND

In conventional methods for defrosting a refrigerator using a heater, an inflow-preventing valve for preventing a refrigerant from flowing into an evaporator is closed in a state in which a compressor is operated, thereby forcibly reducing an amount of the refrigerant present inside the evaporator. There are methods that carry out the defrosting process based on heat produced by a defrosting heater in the above-mentioned state (for example, see JP-A-H10-38453).

FIG. 5 is a piping diagram of a cooling system, showing the conventional refrigerator-defrosting method disclosed in JP-A-H10-38453.

In FIG. 5, the cooling-cycle-system piping includes a compressor 101, a condenser 102, a dryer 103, a decompressor 104 (capillary tube), an evaporator 105, and a defrosting heater 106. An inflow-preventing valve 107 is provided between the condenser 102 and the dryer 103. The inflow-preventing valve 107 is closed in a state in which the compressor 101 is operated, thereby forcibly reducing an amount of a refrigerant present inside the evaporator 105. In that state, the defrosting process is carried out based on heat produced by the defrosting heater 106. This makes it possible to carry out the defrosting process while preventing the heat produced by the defrosting heater 106 from being consumed as vaporization heat of the refrigerant present inside the evaporator 105.

SUMMARY

However, in the conventional configuration, since the amount of refrigerant is reduced inside the evaporator 105 during the defrosting process, temperature-equalization effects based on the refrigerant would be inferior. Consequently, variations in temperature would be caused due to delays in temperature elevation of an upper part of the evaporator 105, insufficiency of temperature elevation in spots that large amounts of frosts have adhered to, etc. As a result, the time required to complete defrosting the entire body of the evaporator 105 would be prolonged, the inside of the cooling chamber would be hot, and thus, a significant amount of electric power would be required for again cooling the inside of the chamber.

Moreover, since the time required for the defrosting process is prolonged, the time of energization of the defrosting heater 106 will also be prolonged, and thus, the amount of electric power consumed by the heater will be increased. Furthermore, due to the temperature variations, the conventional arts have the following problem. That is, the defrosting process would be completed in a state in which frost remain on some parts of the evaporator, and thus, the load of the cooling process after the defrosting process will be increased.

The disclosure solves the above-mentioned problems in the conventional arts, and the purpose thereof is to provide evaporators, methods for defrosting an evaporator, and cooling apparatuses using the evaporator, in which heat produced by a defrosting heater is conveyed to an upper part of the evaporator without wasting the heat to increase the temperature of the entire body of the evaporator, thereby reducing the electric power consumption.

In order to achieve the above purpose, according to the first aspect of the disclosure, provided is a method for defrosting an evaporator, including: (i) closing an outlet part that serves as a refrigerant outlet of the evaporator; (ii) closing an inlet part that serves as a refrigerant inlet of the evaporator; (iii) connecting the outlet part and the inlet part to one another; (iv) heating the evaporator.

Moreover, according to the second aspect of the disclosure, provided is a evaporator, including: an inlet part that serves as a refrigerant inlet; a switching valve that is placed in the inlet part; an outlet part that serves as a refrigerant outlet; a switching valve that is placed in the outlet part; a bypass pathway that connected the inlet part and the outlet part to one another; a horizontal pipe that is communicated with the inlet part; and a vertical pipe that connects the horizontal pipe and the outlet part to one another.

Furthermore, according to the third aspect of the disclosure, provided is a cooling apparatus, including: a compressor that compresses a refrigerant; a condenser; a decompressor; the above evaporator according to the first aspect of the disclosure; and a heater that heats the evaporator.

According to the disclosure, the heat produced by the defrosting heater can be conveyed to an upper part of the evaporator without wasting the heat, the temperature of the evaporator can be elevated while suppressing variations in the temperature throughout the entire body of the evaporator, thereby reducing an amount of electric power consumed during the defrosting process.

DESCRIPTION OF EMBODIMENTS

Hereinafter, embodiments of the disclosure will be described with reference to the drawings.

First Embodiment

Figure 1:
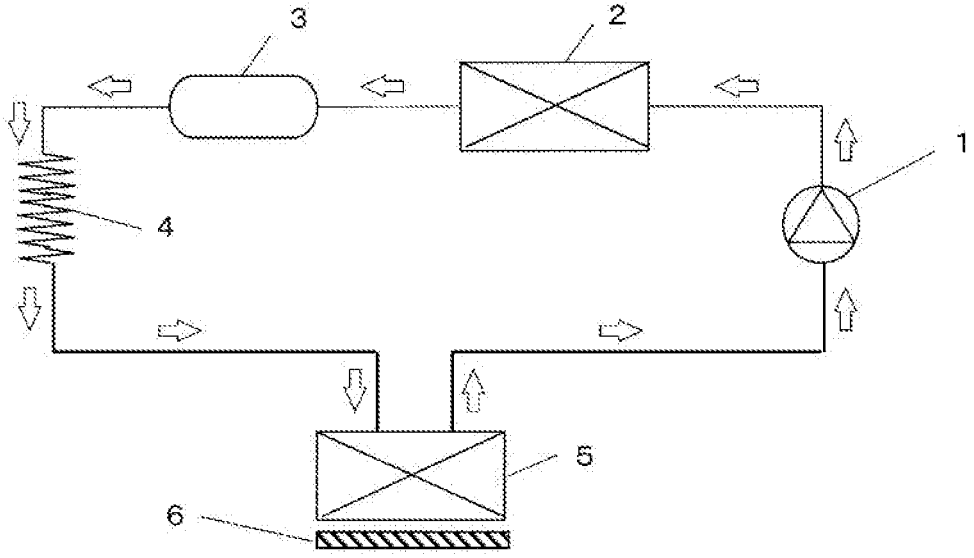
FIG. 1 is a piping diagram of a cooling cycle system in a first embodiment of the disclosure.

FIG. 1 is a diagram that depicts pipes and components in a cooling-cycle system in a cooling apparatus in the first embodiment of the disclosure.

Besides the pipes, the cooling-cycle system, in the cooling apparatus includes: a compressor 1; a condenser 2; a dryer 3; a decompressor 4 (capillary tube); an evaporator 5; and a defrosting heater 6 (heater).

The compressor 1 compresses low-temperature and low-pressure refrigerant (gas), and thus, converts it into a high-temperature and high-pressure state.

The condenser 2 is a heat-exchanger. The condenser 2 condenses the high-temperature and high-pressure gaseous refrigerant, and releases heat to the environment.

The dryer 3 absorbs water present in the cooling cycle system. The dryer 3 is not necessarily required, and may not be provided in the cooling-cycle system. However, the presence of such a dryer 3 is preferable.

The decompressor 4 reduces the pressure of the high-temperature and high-pressure refrigerant, and thus, converts it into a low-temperature and low-pressure state.

The evaporator 5 is a heat-exchanger. The evaporator 5 causes the low-temperature and low-pressure gas-liquid-mixture-layer refrigerant to evaporate, thereby depriving the environment of heat.

The defrosting heater 6 is a heater, just as the term indicates. The defrosting heater 6 is utilized for heating the evaporator 5. The present of such a defrosting heater 6 is preferable although it is not necessarily required.

The cooling-cycle system configured in the above-mentioned manner is operated, and thus, the cool air produced in the evaporator 5 is circulated inside the cooling apparatus by use of a fan, thereby freezing or refrigerating foods.

In that case, if the evaporator 5 is continuously utilized, water adheres to the evaporator 5 in form of frost, and thus, heat-exchange performance of the evaporator 5 will be deteriorated as the frosts grow. In order to restore the deteriorated heat-exchange performance, the cooling operation is temporarily halted (i.e. operation of the compressor 1 is halted), electric power is supplied to the defrosting heater 6, and the evaporator 5 is heated, thereby conducting the defrosting process. The series of operations is referred to as defrosting operation. During the defrosting operation, the liquid refrigerant inside the evaporator 5 is caused to vaporize.

<Structure of the Evaporator 5>

Figure 2A:
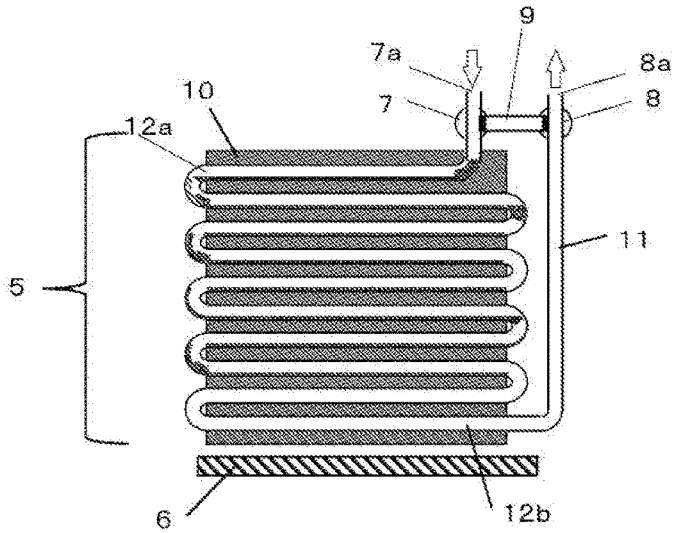
FIG. 2A is a cross-section elevation piping diagram that shows states of flow-channel-switching valves when a cooling operation is carried out with respect to the evaporator in the first embodiment of the disclosure.
Figure 2B:
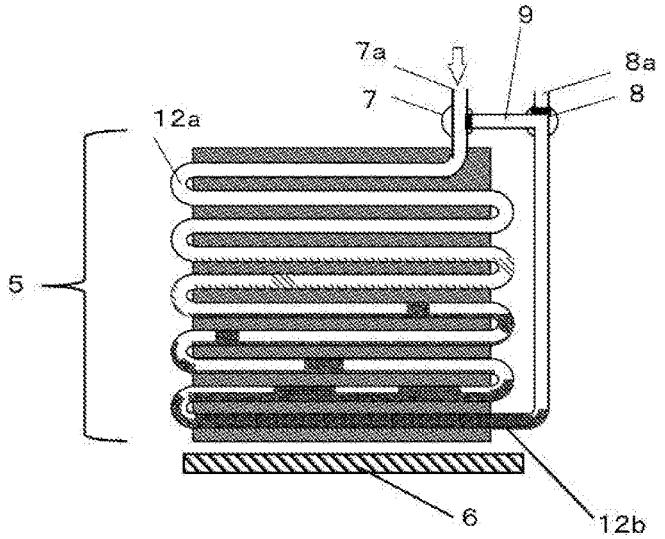
FIG. 2B is a cross-section diagram that shows states of flow-channel-switching valves at an early phase of the defrosting process carried out with respect to the evaporator in the first embodiment of the disclosure.
Figure 2C:
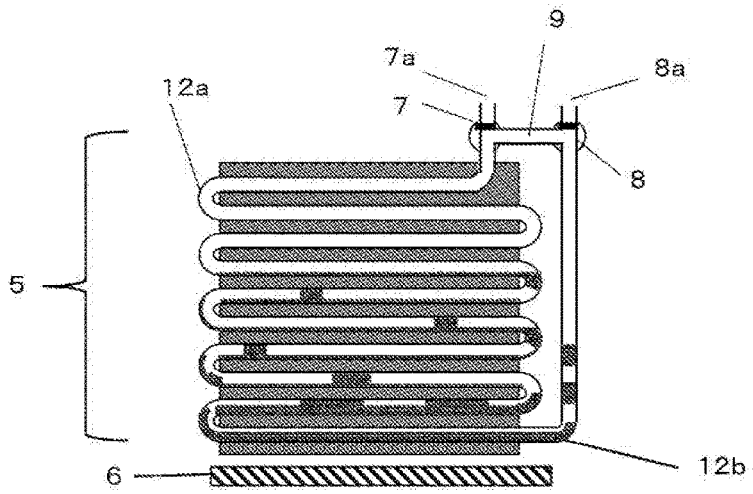
FIG. 2C is a cross-section diagram that shows states of flow-channel-switching valves during the defrosting process carried out with respect to the evaporator in the first embodiment of the disclosure.

FIGS. 2A to 2C are cross-section piping diagrams in cases where the evaporator 5 in the first embodiment 5 is viewed from the front. The evaporator 5 includes a horizontal pipe 12*a* and a vertical pipe 11.

The horizontal pipe 12*a* is formed by causing one pipe to wind its way around edges of the evaporator 5, thus coming with ten tiers, in the vertical direction. That is, in the disclosure, the horizontal pipe 12*a* may include a horizontal part (or horizontal parts) and a curved part (or curved parts). The horizontal part (s) may be configured so as to be linear, and may be placed in the vertical direction. In this embodiment, the horizontal pipe 12*a* includes ten horizontal parts that are arrayed parallel to each other in the vertical direction, and curved parts are present between adjacent horizontal parts.

Although the horizontal pipe 12*a* is arranged as one row in the front-back direction in this embodiment, it may be arranged as three rows in the front-back direction in some embodiments. In that case, with regard to connection of the three rows, the horizontal pipe 12*a* may run from the inlet 7*a*, located in the upper part of the evaporator 5, to the lower part in the first row, may run from the lower part to the upper part in the second row, may run the upper part to the lower part in the third row, and then, may lead to an outlet 8*a*. That is, the three rows form a single pathway in that case.

The vertical pipe 11 connects the downstream side of the lowest horizontal part of the horizontal pipe 12*a* (a part of the horizontal pipe 12*a* located in the lowest tier) to the outlet 8*a* in a linear manner.

A fin 10 used for promoting heat-exchange is attached to the horizontal pipe 12*a* and the vertical pipe 11.

As a result, the evaporator 5 serves as a type of heat-exchanger including the fin 10 and the tube. In FIGS. 2A to 2C, the fin 10 is depicted in a simplified manner.

Additionally, with regard to the horizontal pipe 12*a*, a horizontal part thereof that is located in the lowest tier and that is connected to the vertical pipe 11 may be referred to as the lowest horizontal part 12*b* (of the horizontal pipe 12*a*) in the disclosure.

In the evaporator 5, a switching valve 7 for an inlet part (inlet flow channel), a switching valve 8 for an outlet part (outlet flow channel), a bypass pathway 9 that connects the inlet part and the outlet part, a vertical return pipe 11 that leads to the outlet 8*a*, and the lowest horizontal part 12*b* located upstream of the vertical return pipe 11.

<Process>

FIG. 2A is a diagram that shows states of the switching valve 7 for the inlet part (inlet flow channel) and the switching valve 8 for the outlet part (outlet flow channel) during the normal cooling operation. A gas-liquid two-phase refrigerant penetrates into the evaporator 5 through the inlet 7*a*, and is evaporated inside the evaporator 5, and the refrigerant vaporized by depriving the environment of heat is released from the outlet 8*a* of the evaporator 5.

Step (i)

FIG. 2B is a diagram that shows states of the switching valve 7 for the inlet part (inlet flow channel) and the switching valve 8 for the outlet part (outlet flow channel) in the evaporator 5 at the start of the defrosting operation. Simultaneously with the halt of the compressor 1, the switching valve 8 is closed, and the bypass pathway 9 is opened. Accordingly, the refrigerant that flows into a lower part of the evaporator 5 due to a difference in pressures is stored therein. By switching the switching valve 8 prior to the switching valve 7, it becomes possible to store as much of the refrigerant as possible inside the evaporator 5.

Step (ii)

After the compressor 1 is halted, a difference in pressure inside the cooling-cycle system (an in-pipe pressure difference in the inlet part 7*a* of the evaporator 5) is reduced, and thus, flowing of the refrigerant into the evaporator 5 is slowed, the switching valve 7 for the inlet part is closed as shown in FIG. 2C.

In that case, the term (in-pipe) pressure difference refers to a pressure difference during the cooling operation. The high-pressure side refers to a pressure in the pipe downstream of the compressor 1 and upstream of the decompressor 4, or a pressure in the pipe upstream or downstream of the condenser 2. On the other hand, the low-pressure side refers to a pressure in the pipe downstream of the decompressor 4 and upstream of the compressor 1, or a pressure in a pipe upstream or downstream of the evaporator 5. Thus, the above-mentioned (in-pipe) pressure difference refers to a pressure difference between the high-pressure side and the low-pressure side.

Step (iii)

The bypass pathway 9 is opened. Accordingly, a circuit in which only the pipe within the evaporator 5 is closed is provided, and the gas and the liquid are circulated therein. In that case, the outlet part and the inlet part of the evaporator 5 are connected directly to one another (via the bypass pathway 9).

Step (iv)

In order to cause the refrigerant to circulate inside the evaporator 5, electric power is supplied to the defrosting heater 6 to start heating the evaporator 5.

<Advantages>

According to the above-described configuration and control of the valves, the refrigerant that has been accumulated in a liquid state in the lower part of the evaporator 5 during the defrosting operation is vaporized due to heat produced by the defrosting heater 6, and moves to the upper part of the evaporator 5 through the bypass pathway 9.

Based on the above feature, the upper part of the evaporator 5 can be heated based on the latent heat of condensation of the refrigerant. Then, the refrigerant that has been condensed and liquefied in the upper part of the evaporator 5 is again, accumulated in the lower part of the evaporator 5, is again heated and vaporized by the defrosting heater 6, and moves to the upper part of the evaporator 5. By setting the pipe in the evaporator 5 to a closed flow channel, the refrigerant can be circulated inside the evaporator 5 as described above, the heat produced by the defrosting heater 6, which is used for vaporization, of the refrigerant, will not be wasted at all, and the upper part of the evaporator 5, which has conventionally been difficult to heat, can be heated by the latent heat of condensation of the refrigerant.

In addition, in the first embodiment, although electric power is supplied to the defrosting heater 6 after the halt of the compressor 1, electric power may be supplied to the defrosting heater 6 prior to the halt of the compressor 1 depending on a cover and/or a structure of the defrosting heater 6, and a temperature state of the environment around the evaporator 5.

Second Embodiment

Figure 3A:
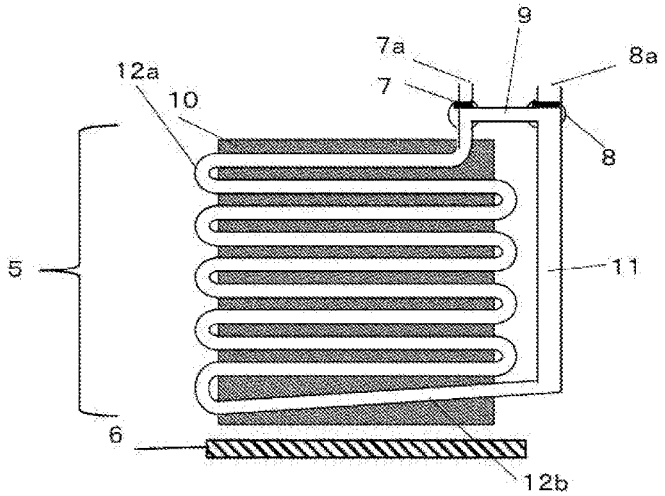
FIG. 3A is a cross-section elevation view of a pipe in an evaporator in a second embodiment of the disclosure.

FIG. 3A is a cross-section diagram that shows a pipe in an evaporator 5 according to the second embodiment of the disclosure when viewed from the front. With regards to a difference between the first and second embodiments, a configuration of the lowest horizontal part 12*b* that is located in a lower part of the evaporator 5 and upstream of a vertical pipe 11 in the second embodiment differs from the configuration of the lowest horizontal part 12*b* in the first embodiment. In FIG. 3A, the same components as those present FIG. 1 and FIGS. 2A to 2C are denoted by the same reference symbols, and descriptions thereof will be omitted. Parts not mentioned in this embodiment are the same as those in the first embodiment.

The evaporator 5 is a tube-type heat-exchanger that includes a fin 10, and a horizontal pipe 12*a* that is formed by causing one pipe to wind its way around edges of the evaporator 5, thus coming with ten tiers, in the vertical direction. In the second embodiment, the horizontal pipe 12*a* includes ten horizontal parts, and curved parts are present between adjacent horizontal parts, in the same manner as the first embodiment. However, the second embodiment differs from, the first embodiment in that the lowest horizontal part 12*b* is not parallel to the other horizontal parts, and is somewhat inclined against the horizontal direction, as described below.

Moreover, although the horizontal pipe 12*a* is arranged as one row in the front-back direction in this embodiment, it may be arranged as three rows in the front-back direction, as described in the first embodiment.

In addition, in FIG. 3A, the fin 10 is depicted in a simplified form.

The vertical return pipe 11 that leads to the outlet of the evaporator 5 is configured in such a manner that a cross-section area of the vertical return pipe 11 is about 20% larger than a cross-section area of the horizontal pipe 12*a*. Particularly, an inner diameter of the vertical return pipe 11 is larger than an inner diameter of the horizontal pipe 12*a*.

The lowest horizontal part 12*b* differs from the other horizontal parts of the horizontal pipe 12*a* in the following way. That is, the lowest horizontal part 12*b* is inclined by about two degrees such that the downstream side thereof (i.e., the side adjacent to the vertical pipe 11) is located in a position higher than the horizontal direction. In addition, the other horizontal parts of the horizontal pipe 12*a* are parallel to the horizontal direction.

Additionally, although the cross-section area of the vertical return pipe 11 is configured so as to be 20% larger than the cross-section area of the horizontal pipe 12*a* in the second embodiment, the cross-section area of the vertical return pipe 11 is not limited to such a configuration, depending on a type of a refrigerant flowing therethrough, and a pipe diameter. Even in cases where the cross-section area of the vertical return pipe 11 is configured so as to be about 10% larger than the cross-section area of the horizontal pipe 12*a*, a flow channel resistance toward the vertical return pipe 11 would be reduced, and advantageous effects would be brought about.

In addition, the lowest horizontal part 12*b* is configured so as to be inclined by about two degrees such that the downstream side thereof (i.e., the side adjacent to the vertical pipe 11) is located in a position higher than the horizontal direction in the second embodiment. However, even in cases where the lowest horizontal part 12*b* is configured so as to be inclined within a range from one to five degrees, it would be possible to obtain advantageous effects. If the inclination angle exceeds five degrees, then, the lowest horizontal part 12*b* may interfere with the horizontal part directly above it, and therefore, such a configuration may be unacceptable. If the inclination angle is smaller than one degree, then, refrigerant-circulation effects may be deteriorated.

Figure 3B:
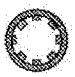
FIG. 3B is a cross-section diagram of a horizontal pipe located upstream of a vertical return pipe in the evaporator according to the second embodiment of the disclosure.

Moreover, FIG. 3B is a cross-section diagram of the vertical pipe 11 and the lowest horizontal part 12*b*. As shown in FIG. 3B, a minute groove geometry is formed on inner surfaces of the vertical pipe 11 and the lowest horizontal part 12*b* in the second embodiment.

Additionally, such a minute groove geometry may be formed on the inner surface of the horizontal parts 12*a* other than the lowest horizontal parts 12*b* of the horizontal pipe 12*a*. However, it is particularly preferable that minute groove geometries are formed only on the inner surfaces of the vertical pipe 11 and the lowest horizontal part 12*b*.

Alternatively, a minute groove geometry may be formed on the inner surface of either one of the vertical pipe 11 and the lowest horizontal part 12*b*.

The minute groove geometry refers to a channel having a smaller cross-section area, and the cross-section thereof may be tetragonal(square/rectangular) or trapezoidal. Furthermore, the minute groove geometry may be formed in linear grooves or in a screw-shaped groove, as found in gun barrels, in the longitudinal direction. Structures such as wicks (center cores of capillary structures) on inner walls of heat pipes may be adopted, and, also in that case, the same advantageous effects would be obtained.

<Advantages>

According to the above configuration, the lowest horizontal part 12*b*, which is present in the lower part of the evaporator 5, is inclined so as to become higher toward the outlet 8*a*. Moreover, the cross-section area, of the vertical pipe 11 is larger than the cross-section area of the horizontal pipe 11*a*. Furthermore, minute groove geometries are provided on inner surfaces of the vertical pipe 11 and the lowest horizontal part 12*b*.

According to the above features, the liquid refrigerant will be present along the wall surfaces of the pipes due to surface tension, and thus, the refrigerant that has been vaporized in the lower part of the evaporator 5 due to heat produced by the defrosting heater 6 during the defrosting operation, and the liquid reagent that has not yet been vaporized can smoothly pass each other.

In other words, the vaporized refrigerant is never impeded by the liquid refrigerant, and thus, can efficiently be conveyed to the upper part of the evaporator 5. As a result, the heat that is produced by the defrosting heater 6 and that is used for vaporization of the refrigerant will not be wasted. Furthermore, the upper part of the evaporator 5, which was conventionally difficult to heat, can be heated based on the latent heat of condensation of the refrigerant.

Third Embodiment

Figure 4A:
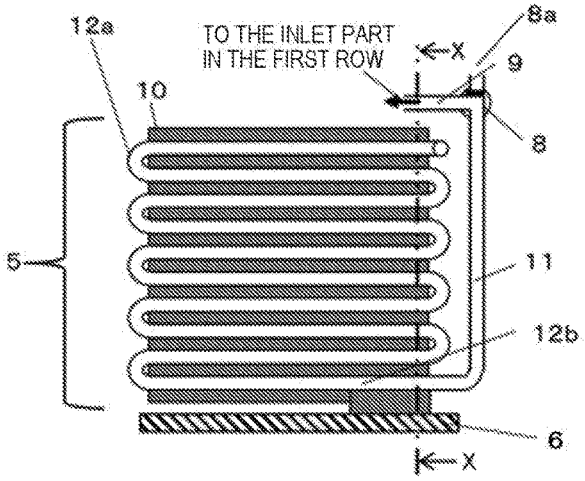
FIG. 4A is a cross-section diagram of an evaporator and a pipe in a third embodiment.
Figure 4B:
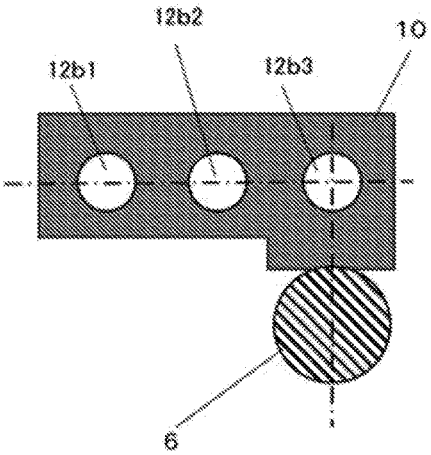
FIG. 4B is an enlarged cross-section diagram of a lower part of the evaporator in the third embodiment.
Figure 5:
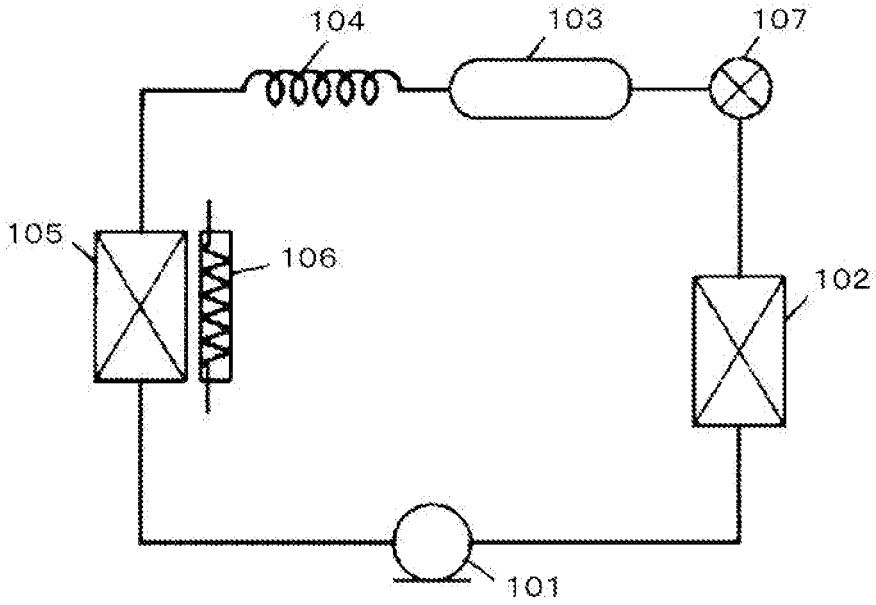
Prior Art FIG. 5
FIG. 5 is a cooling-cycle-system piping diagram that shows the conventional refrigerator-defrosting method disclosed in JP-A-H10-38453.

FIGS. 4A and 4B are cross-section diagrams of certain parts of an evaporator 5 according to the third embodiment of the disclosure. Matters not mentioned in this embodiment are the same as those in the first embodiment and/or the second embodiment. With regards to a difference between the third embodiment and the first or second embodiment, a relationship between a defrosting heater 6 and the lowest horizontal part 12*b* differs from that in the first or second embodiment. In FIGS. 4A and 4B, the same components as those in FIGS. 1 and 2 are denoted by the same reference symbols, and descriptions thereof will be omitted. Parts not mentioned in this embodiment are the same as the corresponding parts in the first and second embodiments.

The evaporator 5 is a tube-type heat-exchanger that includes a fin 10, and a horizontal pipe 12*a* that is formed by causing one pipe to wind its way around edges of the evaporator 5, thus coming with ten tiers, in the vertical direction. Furthermore, in this embodiment, the horizontal pipe 12*a* is arranged as three rows in the front-back direction of the evaporator 5. With regards to connection of the three rows, the horizontal pipe 12*a* runs from a refrigerant inlet, located in the upper part of the evaporator 5, to the lower part in the first row, then runs from the lower part to the upper part in the second row, further runs from the upper part to the lower part in the third row, and then, leads to a refrigerant outlet 8*a*. That is, the horizontal pipe 12*a* runs from the upper part to the lower part of the evaporator 5, or from the lower part to the upper part of the evaporator 5, while winding to form horizontal parts and curved parts, in each row. The horizontal pipe 12*a* is formed as a single pathway throughout the three rows.

In addition, in FIGS. 4A and 4E, the fin 10 is depicted in simplified form.

Specifically, FIG. 4A is a cross-section diagram of the evaporator 5, including the fin 10, a part of the horizontal pipe 12*a* in the third row, a vertical pipe 11, a defrosting heater 6, etc. FIG. 4B is an enlarged cross-section view of parts of the fin 10 and the defrosting heater 6 along the line X-X in FIG. 4A. In the part of the fin 10, the lowest horizontal parts 12*b*1, 12*b*2 and 12*b*3 (recognized as three pipes) of the horizontal pipe 12*a*, forming the lowest tier (three rows), will be recognised. The lowest horizontal parts 12*b*1, 12*b*2 and 12*b*3 are located around the front side, the middle part, and the back side, respectively, in the lower part of the evaporator 5.

The defrosting heater 6 is placed below the lowest horizontal part 12*b*3, which is present in the third row proximate to the vertical pipe 11, and around the back side and the lower part of the evaporator 5, and contacts the fin 10 near the vertical return pipe 11.

<Advantages>

According to the above-described configuration, the liquid refrigerant that has been accumulated around the vertical pipe 11 can efficiently be vaporized based on heat produced by the defrosting heater 6, and thus, elevation of the temperature in the upper part of the evaporator 5 can be promoted.

Based on the above configuration, the refrigerant that has been, vaporized in the lower part of the evaporator 5 by the defrosting heater 6 never flows out of the evaporator 6, is conveyed to the upper part of the evaporator 6, and then, is condensed therein. Thus, based on the latent heat of condensation of the refrigerant, it becomes possible to raise the temperature, of the upper part of the evaporator 5, although, the temperature was conventionally difficult to raise.

(Throughout the Disclosure)

The lowest horizontal part 12*b*, which is present in the lower part of the evaporator 5, is not limited to the above-described part of horizontal pipe 12*a* that is present immediately upstream of the vertical return pipe 11. Multiple pipes that may serve as the horizontal pipe 12*a* and that are present, in a lower part of the evaporator 5 can be configured as multiple lowest horizontal parts 12*b*.

According to the disclosure, by use of refrigerants inside cooling-cycle systems, heat produced by defrosting heaters can be conveyed to upper parts of evaporators without wasting the heat, and thus, entire bodies of evaporators can be heated. As a result, the disclosure brings about effects to reduce power consumption during defrosting processes, and therefore, can be applied to defrosting processes not only for household and professional-use cooling devices but also for any other various cooling apparatuses.

What is claimed is:

1. A method for defrosting an evaporator, comprising:

(i) closing an outlet part that serves as a refrigerant outlet of the evaporator;

(ii) closing an inlet part that serves as a refrigerant inlet of the evaporator;

(iii) connecting the outlet part and the inlet part to one another so that the outlet part and the inlet part are connected directly to one another; and (iv) heating the evaporator.

2. The method according to claim 1, wherein Step (ii) is conducted after Step (i).

3. The method according to claim 1, wherein Step (ii) is conducted after Step (i) and after an in-pipe pressure difference in the inlet part becomes zero.

4. An evaporator, comprising:

an inlet part that serves as a refrigerant inlet;

a first switching valve that is placed in the inlet part;

an outlet part that serves as a refrigerant outlet;

a second switching valve that is placed in the outlet part;

a bypass pathway that connects the inlet part and the outlet part to one another;

a horizontal pipe that is communicated with the inlet part; and a vertical pipe that connects the horizontal pipe and the outlet part to one another.

5. An evaporator, comprising:

an inlet part that serves as a refrigerant inlet;

a first switching valve that is placed in the inlet part;

an outlet part that serves as a refrigerant outlet;

a second switching valve that is placed in the outlet part;

a bypass pathway that connected the inlet part and the outlet part to one another;

a first pipe that is communicated with the inlet part; and a second pipe that connects the first pipe and the outlet part to one another, wherein the first pipe includes horizontal parts and a curved part, the horizontal parts are each configured so as to be linear, and the horizontal parts are placed in a vertical direction.

6. The evaporator according to claim 4, wherein the vertical pipe is configured so as to be linear in a vertical direction.

7. The evaporator according to claim 4, wherein a minute groove geometry is provided inside the vertical pipe.

8. The evaporator according to claim 5, wherein a minute groove geometry is provided inside the lowest horizontal part of the first pipe.

9. The evaporator according to claim 5, wherein a downstream side of the lowest horizontal part of the first pipe is located at a position higher than an upstream side of said lowest horizontal part.

10. The evaporator according to claim 5, wherein a heater is provided below the lowest horizontal part of the first pipe.

11. The evaporator according to claim 5, wherein the outlet part and the inlet part are provided in an upper part of the evaporator, the first pipe is configured so as to wind toward a direction from the upper part to a lower part of the evaporator, such that the horizontal parts are provided in the first pipe, and the second pipe connects the lowest horizontal part of the first pipe and the outlet part to one another.

12. The evaporator according to claim 4, wherein the evaporator is incorporated within a cooling apparatus, the cooling apparatus, comprising:

a compressor that compresses a refrigerant;

a condenser;

a decompressor;

and a heater that heats the evaporator.

* * * * *